US007262392B1

(12) United States Patent
Miller

(10) Patent No.: US 7,262,392 B1
(45) Date of Patent: Aug. 28, 2007

(54) UNIFORM THERMAL PROCESSING BY INTERNAL IMPEDANCE HEATING OF ELONGATED SUBSTRATES

(75) Inventor: Gregory A. Miller, Menlo Park, CA (US)

(73) Assignee: Nanosolar, Inc., Palo Alto, CA (US)

( * ) Notice: Subject to any disclaimer, the term of this patent is extended or adjusted under 35 U.S.C. 154(b) by 443 days.

(21) Appl. No.: 10/943,659

(22) Filed: Sep. 18, 2004

(51) Int. Cl.
*H05B 6/60* (2006.01)
*H05B 6/10* (2006.01)

(52) U.S. Cl. ..... 219/645; 219/646

(58) Field of Classification Search ..... 219/645, 219/646, 635, 637, 643, 619, 773, 216; *H05B 6/60*
See application file for complete search history.

(56) References Cited

U.S. PATENT DOCUMENTS 4,405,386 A * 9/1983 Mravic et al. ..... 148/567
4,665,303 A * 5/1987 Miyakawa et al. ..... 219/216
5,567,448 A * 10/1996 Frankland ..... 425/363
5,571,368 A * 11/1996 Barge ..... 156/359
6,239,411 B1 * 5/2001 Ito ..... 219/216
6,438,349 B2 * 8/2002 Ando ..... 399/333
6,849,837 B2 * 2/2005 Riess et al. ..... 219/634
2002/0012846 A1 * 1/2002 Skotheim et al. ..... 429/231.95
2002/0148830 A1 * 10/2002 Ross ..... 219/670
2004/0219730 A1 11/2004 Basol ..... 438/200

OTHER PUBLICATIONS

U.S. Appl. No. 10/782,545, titled "High Throughput Surface Treatment on Coiled Flexible Substrates", filed Feb. 19, 2004, (NSL-025).
U.S. Appl. No. 10/782,017, titled "Solution-Based Fabrication of Photovoltaic Cell", filed Feb. 19, 2004, (NSL-029).
U.S. Appl. No. 10/943,658, titled "Formation of CIGS Absorber Layer Materials Using Atomic Layer Deposition and High Throughput Surface Treatment", filed Sep. 18, 2004, (NSL-035).
U.S. Appl. No. 10/943,685, titled "Formation of CIGS Absorber Layers on Foil Substrates", filed Sep. 18, 2004 (NSL-038).

* cited by examiner

*Primary Examiner*—Daniel Robinson
(74) *Attorney, Agent, or Firm*—Joshua D. Isenberg; JDI Patent

(57) ABSTRACT

An elongated substrate may be heated in a roll processing system. At least a portion of the elongated substrate is loaded into the roll processing system. A sufficient electrical current is caused to flow in the portion of the elongated substrate to heat the portion to a desired temperature. The heating may be either resistive or inductive. The roll processing system may be a roll-to-roll type where the substrate moves as a portion of it is heated. Alternatively, the substrate may be wound into a coiled substrate and the turns of the coil insulated against undesired electrical contact. The entire coiled substrate may then be heated either resistively or inductively.

23 Claims, 3 Drawing Sheets

UNIFORM THERMAL PROCESSING BY INTERNAL IMPEDANCE HEATING OF ELONGATED SUBSTRATES

CROSS-REFERENCE TO RELATED APPLICATION

This application is related to commonly-assigned, co-pending application Ser. No. 10/943,685, entitled "FORMATION OF SOLAR CELLS ON FOIL SUBSTRATES" which is filed the same day as the present application the entire disclosures of which are incorporated herein by reference. This application is also related to U.S. patent application Ser. No. 10/782,545, filed Feb. 19, 2004, entitled "HIGH THROUGHPUT SURFACE TREATMENT ON COILED FLEXIBLE SUBSTRATES", the entire disclosures of which are incorporated herein by reference.

FIELD OF THE INVENTION

The present invention is related to substrate processing and more particularly to heating elongated substrates during processing.

BACKGROUND OF THE INVENTION

Substrate processing typically involves forming structures on a substrate by formation of a sequence of layers of material on a substrate. Often the layer formation processes involve heating the substrate, e.g., to anneal a layer of material. In the semiconductor industry, substrates are often silicon wafers that are 300 mm in diameter or less. Such substrates may be easily heated using standard semiconductor processing equipment.

In the past, photovoltaic devices, such as solar cells, were made on silicon substrates and processed much like semiconductor integrated circuits. Recently, however, in an effort to reduce the cost of solar cells, the solar cell industry has been trying to develop techniques for high-volume fabrication of solar cells, e.g. using roll-to-roll processing. Such techniques often use convective heating or radiative heating (e.g., with infrared lamps). Unfortunately, these prior art techniques often produce non-homogenous heating of the substrate. For example, in a standard furnace, a roll of devices would experience a large temperature gradient depending on whether the 'layer' in question is near the inside or outside of the roll. In addition, these heating techniques can be difficult to design and expensive to implement.

Thus, there is a need in the art, for a method of uniform heating of large area substrates.

BRIEF DESCRIPTION OF THE DRAWINGS

The teachings of the present invention can be readily understood by considering the following detailed description in conjunction with the accompanying drawings, in which.

DESCRIPTION OF THE SPECIFIC EMBODIMENTS

Although the following detailed description contains many specific details for the purposes of illustration, anyone of ordinary skill in the art will appreciate that many variations and alterations to the following details are within the scope of the invention. Accordingly, the exemplary embodiments of the invention described below are set forth without any loss of generality to, and without imposing limitations upon, the claimed invention.

According to embodiments of the present invention an elongated substrate may be heated in a roll processing system. At least a portion of the elongated substrate is loaded into the roll processing system. A sufficient electrical current is caused to flow in the portion of the elongated substrate to heat the portion to a desired temperature. The heating may be either resistive or inductive. The roll processing system may be a roll-to-roll type where the substrate moves as a portion of it is heated. Alternatively, the roll processing system may be a type in which the elongated substrate is wound into a coiled substrate and the turns of the coiled substrate are insulated against undesired electrical contact. The entire coiled substrate may then be heated either resistively or inductively. Examples of embodiments of the present invention are described below and illustrated in FIG. 1 through FIG. 4.

Figure 1:
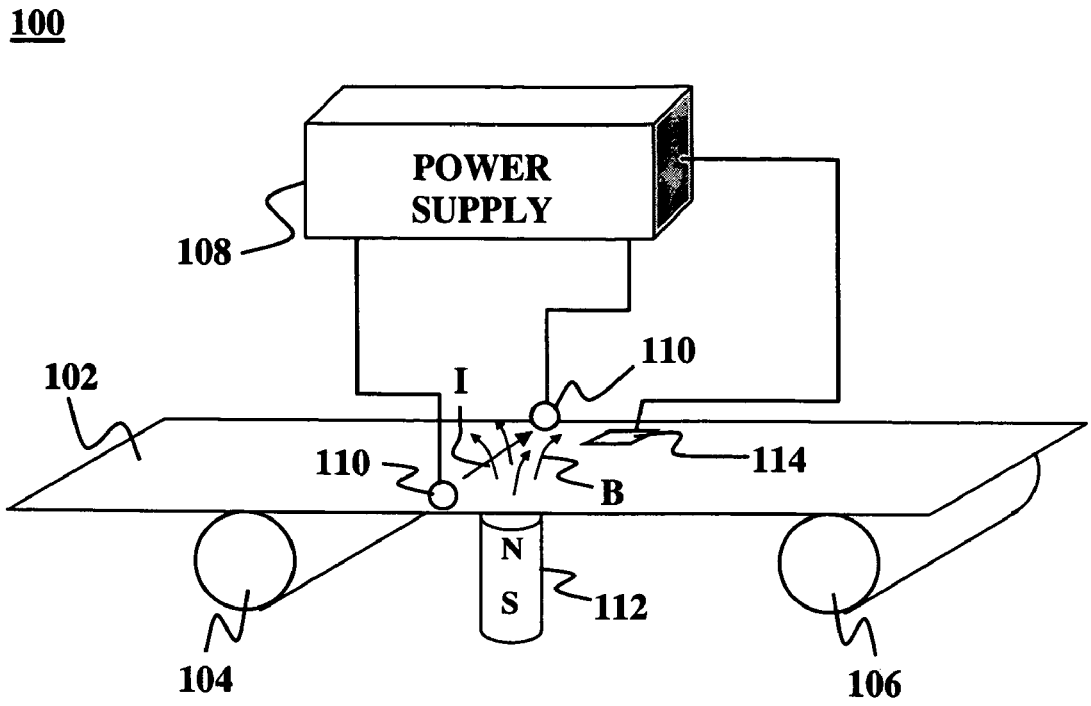
FIG. 1 is a schematic diagram of an apparatus for resistive heating of an elongated substrate according to an embodiment of the present invention.

FIG. 1 depicts a roll-to-roll processing apparatus 100 according to a first embodiment of the present invention. In the apparatus 100 an elongated substrate 102 moves from a first roller 104 to a second roller 106. One or both of the rollers may be motorized to impart movement to the elongated substrate 102. The substrate 102 may be provided to the apparatus 100 from a feed roll (not shown). The elongated substrate 102 is preferably made of sheet of an electrically conductive material, e.g., a metal such as aluminum, stainless steel, copper, molybdenum, etc. Alternatively, the substrate 102 may include multiple layers, at least one of which is an electrically conductive material layer. The substrate 102 may include one or more electronic or photovoltaic devices that are to be heated. The substrate 102 is preferably able to handle the current required to dissipate the necessary power to heat the devices. The substrate 102 may be a 'transfer' or 'host' that enhances the heating properties of another substrate that is attached to it.

An electric power supply 108 is electrically coupled to a portion of the elongated substrate 102 via leads 110. The power supply 108 may be a direct current (DC) supply or an alternating current (AC) supply. In the example depicted in FIG. 1, the leads 110 make electrical contact at or near the edges of the substrate 102. When a voltage is applied between the leads 110 an electric current I flows widthwise through the substrate 102 between leads 110. Alternatively, the leads 110 may be configured such that the current I flows along the length of the substrate 102. For example, leads may be incorporated into the first and second rollers 104, 106 so that the current I flows between them through the substrate 102. A temperature or current flux sensor 114 or array of sensors may be employed to form a closed control loop to adjust the output of the power supply 108.

The voltage between the leads 110 is such that the current I dissipates a power equal to $I^2R$, where R is the resistance of the substrate 102 (or that portion of the substrate through which the current flows). The power density (power divided by the area of the substrate through which the current flows) must be high enough locally to appropriately heat the desired portion of the substrate 102 and any devices formed on it.

The leads 110 may be in the form of rollers or sliding contacts that permit the substrate to move past as the current flows between the leads 110. The leads 110 preferably make contact over a suitable length of the substrate 102 so that the current I is neither too concentrated nor too widely dispersed within the substrate 102. In the example depicted in FIG. 1 two leads 110 (one lead on each side of the substrate 102) are shown for the sake of clarity. A greater number of leads may be used to spread out the current over a greater length of the substrate 102. One or more magnets 112 may provide a magnetic field B that focuses or defocuses the current I so that the substrate 102 is uniformly heated. It is preferable that electromagnets have an adjustable field controlled by an array of temperature and/or current flux sensors 114 which may serve in a closed loop control system with a magnet controller (not shown). The magnet controller may adjust the magnetic field B by adjusting current to an electromagnet or by changing the position or orientation of the magnets 112. Although a single power supply and a single pair of leads are depicted, those of skill in the art will recognize that the above embodiment may be implemented using multiple power supplies connected to multiple pairs of leads.

Figure 2:
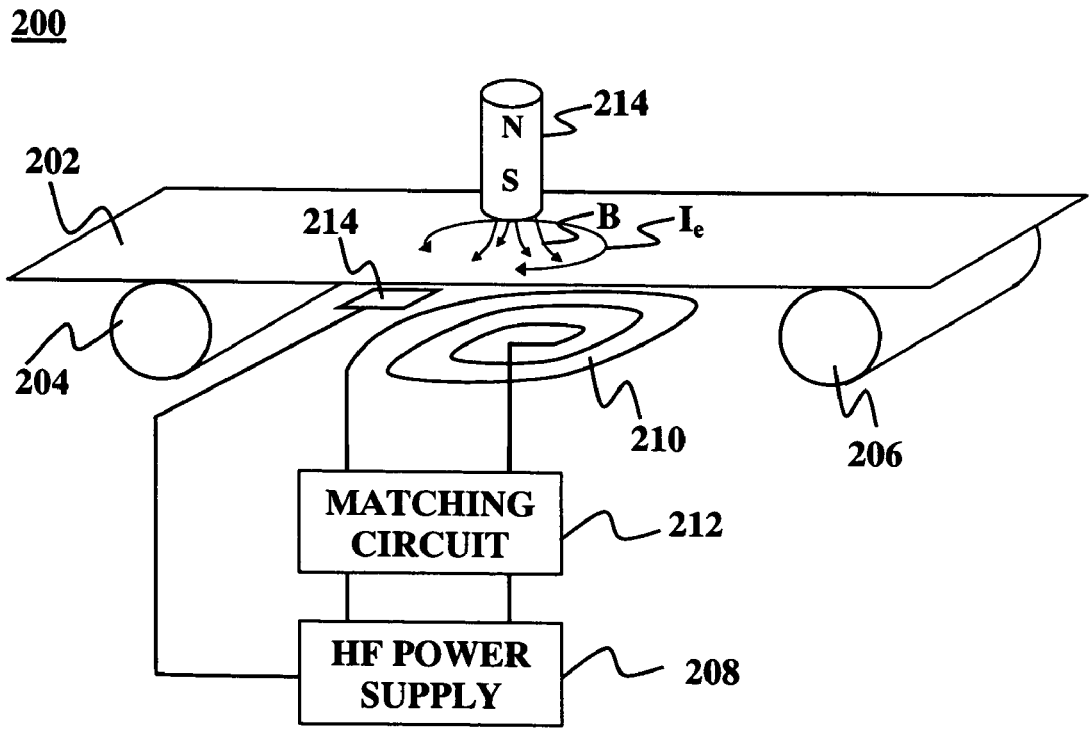
FIG. 2 is a schematic diagram of an apparatus for inductive heating of an elongated substrate according to an alternative embodiment of the present invention.

FIG. 2 depicts an alternative roll-to-roll processing apparatus 200 according to a second embodiment of the present invention. In this embodiment, an elongated substrate 202 moves past rollers 204, 206 much as described above. However, instead of electrical leads, the substrate moves past an inductor 210 that is disposed proximate a surface of the substrate 202. The inductor may be disposed either above or below the substrate 202. The inductor 210 is connected to a high-frequency (HF) power supply 208, where the frequency range is about 1 KHz or greater. The inductor 210 may be in the form of a substantially flat coil having multiple turns. Preferably, the inductor spans the width of the substrate 210. When the HF power supply 208 energizes the inductor with HF power eddy currents $I_e$ are induced in the substrate 202. If sufficient HF power is applied to the inductor 210, the resulting eddy currents can heat the substrate 202 to the desired temperature. The frequency of the HF power may be selected to optimize or allow the substrate to have an impedance in a range that provides an efficient transfer of power by induction to the substrate 202. An HF matching circuit 212 may be coupled between the HF power supply 208 and the inductor 210 to maximize power transfer to the inductors. A temperature sensing circuit 214 may optionally be employed to ensure that the frequency of the HF power is optimal for the substrate material and geometry. The temperature sensing circuit 214 senses the temperature of the substrate 202 and feeds back a corresponding signal to the power supply 208. By way of example, the sensor 214 may be a temperature sensor of any suitable type, e.g., a thermocouple, thermistor, solid-state infrared sensor, and the like. Alternatively, the sensor 214 may be a current flux sensor and/or magnetic field sensor (e.g. configured as a Hall effect sensor) can be used. Combinations of such sensors or arrays of sensors can also be used. The sensing circuit 214 ensures that the HF power and/or frequency are optimal for the substrate material and geometry. This circuitry would allow a closed-loop control situation to ensure stability of substrate heating by the apparatus 200. In addition, one or more magnets 216 may optionally provide a magnetic field B that focuses or defocuses the eddy currents $I_e$. The magnets/electromagnets 216 may be in a closed loop control system comprised in part of a sensing circuit based on temperature and/or current flux at or near a local position.

An advantage of the apparatus 200 is that the substrate 202 can be heated without direct contact between the substrate 202 and the inductor 210. Inductively coupled power transfer eliminates complex substrate contacting equipment and bypass issues associated with them in a continuous process. This would improve the speed at which a continuous process could operate and would eliminate additional contacting equipment. In order to increase the temperature of the substrate, a higher HF power may be used by simply increasing the power output on the power supply. Alternatively, the frequency of the HF power may be changed to increase or lower the impedance of the substrate, which in turn would affect the rate of temperature change. This would allow such a process to work on a wide variety of substrate materials with a multitude of conductivities without requiring a re-design of power supplies and other equipment. In particular, through the use of a variable frequency, the impedance of a substrate can be changed, resulting in a requirement for less current even for the same power dissipation, which allows both thinner materials and/or materials with higher conductivities to be employed.

In the embodiments depicted in FIG. 1 and FIG. 2, a portion of the substrate is heated as it moves past electrical leads or inductors. As stated above, in alternative embodiments of the present invention an elongated substrate may be wound into a coil and then heated in its entirety. Coiled substrates are particularly advantageous in the context of vapor deposition processes such as atomic layer deposition (ALD). Atomic layer deposition on coiled substrates is described, e.g., in U.S. patent application Ser. No. 10/782,545, which has been incorporated herein by reference. Heating such a coiled substrate is problematic for conventional methods such as IR lamps or convection heating due to the narrow spacing between adjacent turns of the coils. If the substrate is electrically conductive, however, the substrate may be heated resistively or inductively.

A key feature for resistive or inductive heating of coiled substrates is to be able to electrically insulate adjacent turns of the coiled substrate from each other in order to prevent electrical shorts that would otherwise result in non-uniform heating. U.S. patent application Ser. No. 10/782,545 describes spacers that are placed between the turns of the coiled substrate to prevent undesired contact between adjacent turns of the coiled substrate. The spacers can be put in place as the substrate is wound into a coil. These spacers can be in the form of slats that are placed at intervals across the width of the coiled substrate or "spacer tapes" that run lengthwise along the edges of the coiled substrate. In either case, the spacers preferably electrically insulating and do not melt or otherwise react adversely during heating of the substrate.

Figure 3A:
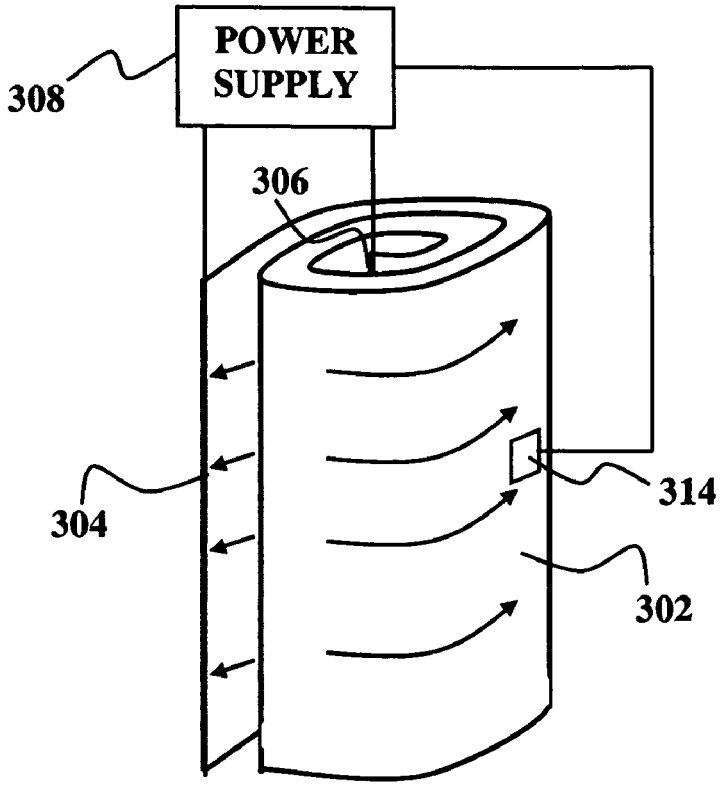
FIG. 3A is a schematic diagram illustrating resistive heating along the length of a coiled elongated substrate according to an alternative embodiment of the present invention.
Figure 3B:
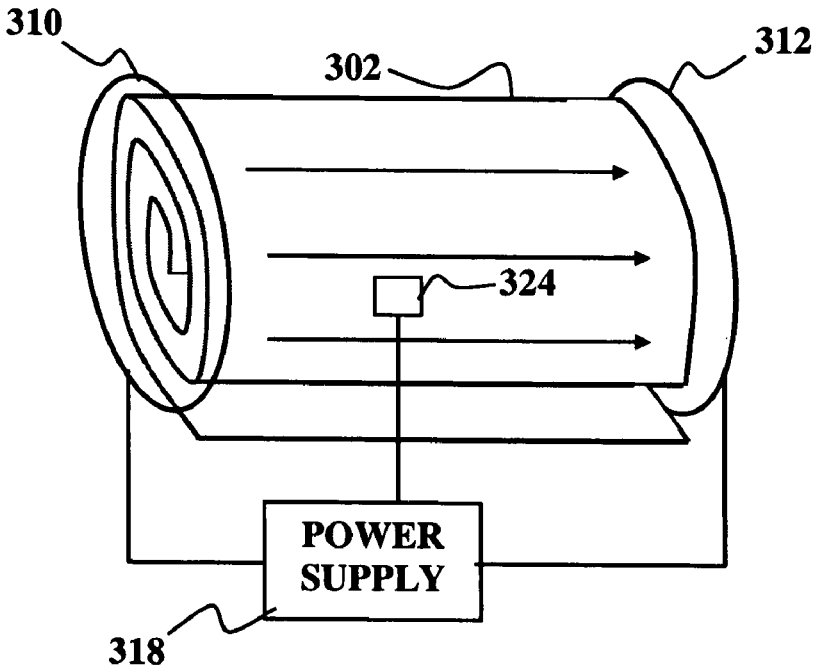
FIG. 3B is a schematic diagram illustrating resistive heating across the width of a coiled elongated substrate according to an alternative embodiment of the present invention.

FIGS. 3A-3B depict alternative schemes for resistively heating a coiled substrate. In FIG. 3A in FIG. 3A an elongated substrate has been rolled into a coil to form a coiled substrate 302. Electrical leads 304, 306 are connected at the ends of the coiled substrate 302. The electrical leads 304, 306 are connected to a power supply (AC or DC). When a power supply 308 applies a voltage between the leads 304, 306, a current flows along the length of the coiled substrate as indicated by the arrows. The current may be regulated, e.g., through use of a sensor 314 coupled to the power supply 318 in a closed control loop circuit. In FIG. 3B, by contrast, electrodes 310, 312 are electrically connected to the edges of the coiled substrate 302. The electrodes 310, 312 are connected to a power supply 318. When a voltage is applied between the electrodes 310, 312 a current flows across the width of the substrate 302 as indicated by the arrows. The current may be regulated, e.g., through use of a sensor 324 coupled to the power supply 318 in a closed control loop circuit.

Figure 4:
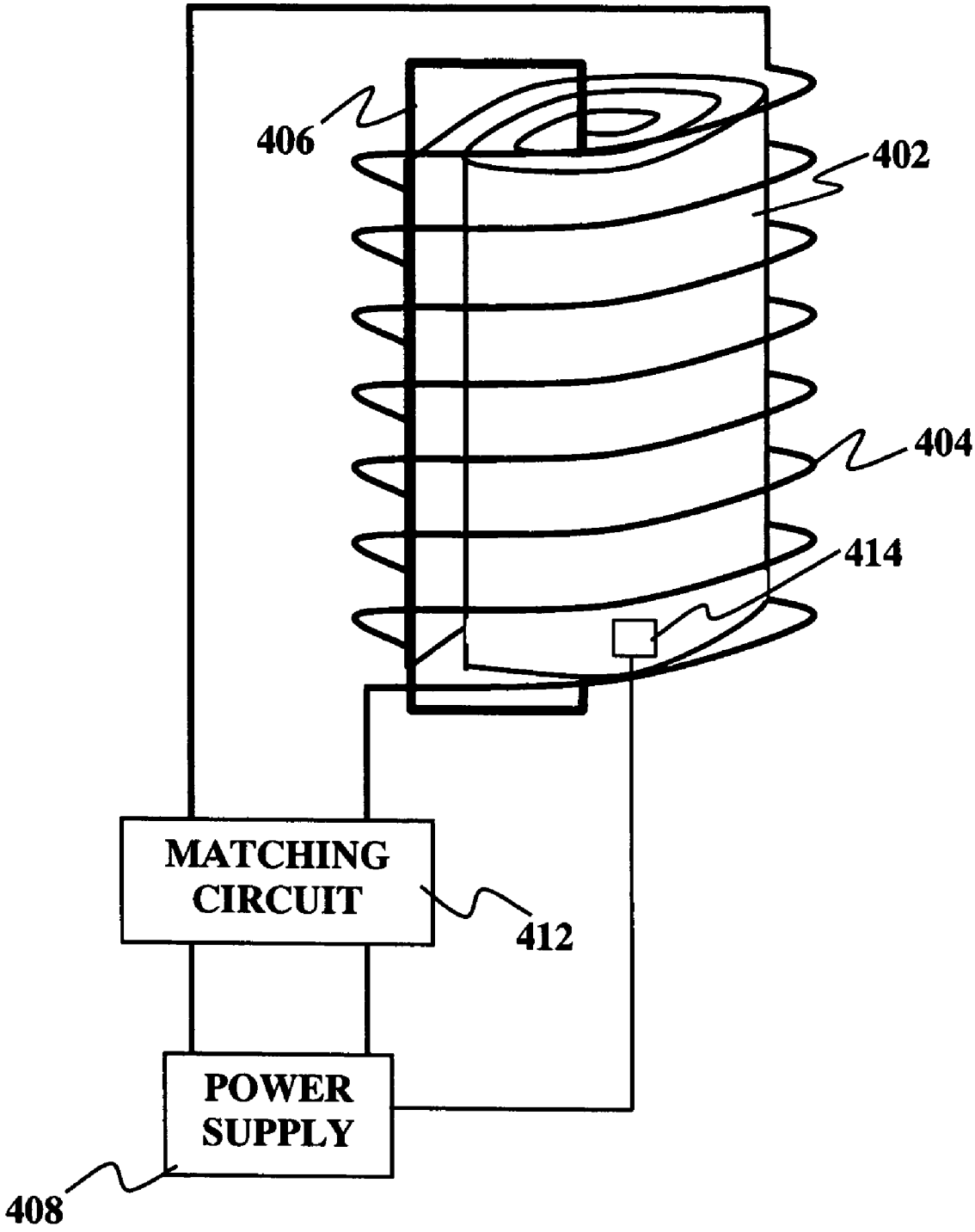
FIG. 4 is a schematic diagram illustrating inductive heating of a coiled elongated substrate according to an alternative embodiment of the present invention.

FIG. 4 depicts an example of inductive heating of a coiled substrate 402. An elongated substrate is wound into a coil, e.g., as described above, to form the coiled substrate 402. The coiled substrate 402 is then placed within an induction coil 404. A bus bar 406 makes electrical contact between first and second ends of the coiled substrate 402. The induction coil 404 is electrically coupled to a radio frequency (or other high-frequency) power supply 408. A matching circuit 412 and sensing circuit 414 may be electrically coupled between the induction coil 404 and the power supply 408. When the power supply is energized, a current is induced in the coiled substrate 402. The power supplied to the induction coil 404 may be regulated through the use of the sensing circuit 414 connected to the power supply 408 in a closed control loop.

Embodiments of the present invention may be used, e.g., for fabrication of absorber layers on aluminum foil substrates. Absorber layers are a key component of efficient photovoltaic devices such as solar cells. Fabrication of the absorber layer on the aluminum foil substrate is relatively straightforward. First, the nascent absorber layer is deposited on the substrate either directly on the aluminum or on an uppermost layer such as an electrode layer. Then the nascent absorb layer may be annealed by rapid resistive or inductive heating of the substrate.

The nascent absorber layer may include material containing elements of groups IB, IIIA, and (optionally) VIA. Preferably, the absorber layer copper (Cu) is the group IB element, Gallium (Ga) and/or Indium (In) and/or Aluminum may be the group IIIA elements and Selenium (Se) and/or Sulfur (S) as group VIA elements. The group VIA element may be incorporated into the nascent absorber layer when it is initially deposited or during subsequent processing to form a final absorber layer from the nascent absorber layer. The nascent absorber layer may be about 1000 nm thick when deposited. Subsequent rapid thermal processing and incorporation of group VIA elements may change the morphology of the resulting absorber layer such that it increases in thickness (e.g., to about twice as much as the nascent layer thickness under some circumstances).

By way of example, a nascent absorber layer containing elements of group IB and IIIA (and optionally VIA) may be formed on an aluminum substrate. The nascent absorber layer may be annealed by rapid resistive or inductive heating of the substrate (or a portion thereof) from an ambient temperature to a plateau temperature range of between about 200° C. and about 600° C. The substrate may be heated at a rate of between about 5° C./sec and about 150° C./sec. The temperature is maintained in the plateau range for between about 2 minutes and about 30 minutes, and subsequently reduced. Alternatively, the annealing temperature could be modulated to oscillate within a temperature range without being maintained at a particular plateau temperature. Rapid thermal processing of such absorber layers is described in commonly-assigned co-pending U.S. patent application Ser. No. 10/943,685, entitled "FORMATION OF SOLAR CELLS ON FOIL SUBSTRATES", which has been incorporated herein by reference.

The nascent absorber layer may be deposited in the form of a film of a solution-based precursor material containing nanoparticles that include one or more elements of groups IB, IIIA and (optionally) VIA. Examples of such films of such solution-based printing techniques are described e.g., in commonly-assigned U.S. patent application Ser. No. 10/782,017, entitled "SOLUTION-BASED FABRICATION OF PHOTOVOLTAIC CELL" and also in PCT Publication WO 02/084708, entitled "METHOD OF FORMING SEMICONDUCTOR COMPOUND FILM FOR FABRICATION OF ELECTRONIC DEVICE AND FILM PRODUCED BY SAME" the disclosures of both of which are incorporated herein by reference.

Alternatively, the nascent absorber layer may be formed by a sequence of atomic layer deposition reactions or any other conventional process normally used for forming such layers. Atomic layer deposition of IB-IIIA-VIA absorber layers is described, e.g., in commonly-assigned, co-pending application Ser. No. 10/643,658, entitled "FORMATION OF CIGS ABSORBER LAYER MATERIALS USING ATOMIC LAYER DEPOSITION AND HIGH THROUGHPUT SURFACE TREATMENT ON COILED FLEXIBLE SUBSTRATES", which has been incorporated herein by reference above.

Embodiments of the present invention can implement substrate heating at relatively low cost since the substrate material is already an integral part of the device. Embodiments of the present invention can also solve issues of thermal non-uniformity that is critical in CIGs cells by heating the entire area of the devices simultaneously with no dependence on substrate or roll geometry.

While the above is a complete description of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents. In the claims that follow, the indefinite article "A", or "An" refers to a quantity of one or more of the item following the article, except where expressly stated otherwise. The appended claims are not to be interpreted as including means-plus-function limitations, unless such a limitation is explicitly recited in a given claim using the phrase "means for."

What is claimed is:

1. A method for heating an elongated substrate in a roll processing system, comprising the steps of:

loading at least a portion of the elongated substrate into the roll processing system; and causing a sufficient electrical current to flow in the portion of the elongated substrate to heat the portion to a desired temperature, wherein causing includes:

electrically contacting first and second leads to the portion of the elongated substrate at spaced apart locations;

applying an electrical voltage between the first and second leads whereby an electric current flows through the substrate between the first and second leads.

2. The method of claim 1 wherein the substrate moves past the first and second leads while the electrical voltage is applied between the first and second leads.

3. The method of claim 1 wherein the first lead electrically contacts the elongated substrate proximate a first edge and the second lead electrically contacts the elongated substrate proximate a second edge whereby the electric current flows across a width of the elongated substrate.

4. The method of claim 1 wherein the first and second leads are configured such that the electric current flows along a length of the elongated substrate.

5. The method of claim 1 wherein causing a sufficient electrical current to flow in the portion of the elongated substrate includes:

disposing an inductor proximate the portion of the elongated substrate; and applying high-frequency power to the inductor.

6. The method of claim 5 wherein the inductor is disposed above the portion of the elongated substrate.

7. The method of claim 5 wherein the inductor is disposed below the portion of the elongated substrate.

8. The method of claim 5 wherein the substrate moves past the inductor while the high-frequency power is applied between the inductor.

9. The method of claim 5 further comprising controlling power from the source of high-frequency power using one or more temperature or flux sensors coupled to a source of the high-frequency power in a closed control loop.

10. The method of claim 1 further comprising loading at least a portion of the elongated substrate into the roll processing system includes coiling the elongated substrate into a coiled substrate.

11. The method of claim 10, further comprising insulating adjacent turns of the coiled substrate against undesired electrical contact.

12. The method of claim 10 wherein causing a sufficient electrical current to flow in the portion of the elongated substrate includes:

electrically contacting a first lead at or near a first edge of the coiled substrate and electrically contacting a second lead at or near a second edge of the of the coiled substrate; and applying an electrical voltage between the first and second leads, whereby the electrical current flows across a width of the coiled substrate.

13. A method for heating an elongated substrate in a roll processing system, comprising:

loading at least a portion of the elongated substrate into the roll processing system;

causing a sufficient electrical current to flow in the portion of the elongated substrate to heat the portion to a desired temperature; and forming a nascent photovoltaic absorber layer containing one or more elements of group IB and one or more elements of group IIIA on an aluminum foil substrate.

14. A method for heating an elongated substrate in a roll processing system, comprising the steps of:

loading at least a portion of the elongated substrate into the roll processing system;

causing a sufficient electrical current to flow in the portion of the elongated substrate to heat the portion to a desired temperature, wherein causing comprises:

electrically contacting first and second leads to the portion of the elongated substrate at spaced apart locations;

applying an electrical voltage between the first and second leads whereby an electric current flows through the substrate between the first and second leads; and focusing or defocusing the electric current with a magnetic field.

15. The method of claim 14, further comprising controlling the magnetic field using one or more temperature sensors, magnetic field sensors or current flux sensors coupled to a magnet controller in a closed control loop.

16. A method for heating an elongated substrate in a roll processing system, comprising the steps of:

loading at least a portion of the elongated substrate into the roll processing system;

causing a sufficient electrical current to flow in the portion of the elongated substrate to heat the portion to a desired temperature, wherein causing comprises:

electrically contacting first and second leads to the portion of the elongated substrate at spaced apart locations;

applying an electrical voltage between the first and second leads whereby an electric current flows through the substrate between the first and second leads; and controlling the electrical voltage using one or more temperature sensors, magnetic field sensors or current flux sensors coupled to a power supply in a closed control loop.

17. A method for heating an elongated substrate in a roll processing system, comprising the steps of:

loading at least a portion of the elongated substrate into the roll processing system; causing a sufficient electrical current to flow in the portion of the elongated substrate to heat the portion to a desired temperature, wherein causing comprises:

disposing an inductor proximate the portion of the elongated substrate; and applying high-frequency power to the inductor focusing or defocusing the electric current with a magnetic field.

18. The method of claim 17, further comprising controlling the magnetic field using one or more temperature sensors, magnetic field sensors or current flux sensors coupled to a magnet controller in a closed control loop.

19. A method for heating an elongated substrate in a roll processing system, comprising the steps of:

loading at least a portion of the elongated substrate into the roll processing system;

causing a sufficient electrical current to flow in the portion of the elongated substrate to heat the portion to a desired temperature;

wherein loading at least a portion of the elongated substrate into the roll processing system includes:

coiling the elongated substrate into a coiled substrate; and insulating adjacent turns of the coiled substrate against undesired electrical contact;

wherein causing a sufficient electrical current to flow in the portion of the elongated substrate includes:

electrically contacting a first lead at or near a first end of the coiled substrate and electrically contacting a second lead at or near a second end of the of the coiled substrate; and applying an electrical voltage between the first and second leads, whereby the electrical current flows along a length of the coiled substrate.

20. The method of claim 19 further comprising measuring a temperature of the coiled substrate with a sensor and controlling a source of the high-frequency power with a signal from the sensor using a closed-loop circuit.

21. A method for heating an elongated substrate in a roll processing system, comprising the steps of:

loading at least a portion of the elongated substrate into the roll processing system;

causing a sufficient electrical current to flow in the portion of the elongated substrate to heat the portion to a desired temperature;

loading at least a portion of the elongated substrate into the roll processing system includes coiling the elongated substrate into a coiled substrate; and insulating adjacent turns of the coiled substrate against undesired electrical contact;

wherein causing a sufficient electrical current to flow in the portion of the elongated substrate includes:

electrically contacting a first end of the coiled substrate to a second end of the coiled substrate;

placing the coiled substrate within an induction coil; and energizing the induction coil to inductively heat the coiled substrate.

22. A method for heating an elongated substrate in a roll processing system, comprising the steps of:

loading at least a portion of the elongated substrate into the roll processing system;

causing a sufficient electrical current to flow in the portion of the elongated substrate to heat the portion to a desired temperature;

forming a nascent absorber layer containing one or more elements of group IB and one or more elements of group IIIA on an aluminum foil substrate;

rapidly heating the nascent absorber layer and/or substrate from an ambient temperature to a plateau temperature range of between about 200° C. and about 600° C.;

maintaining the absorber layer and/or substrate in the plateau temperature range for between about 2 minutes and about 30 minutes; and reducing the temperature of the absorber layer and/or substrate.

23. The method of claim 22 wherein rapidly heating the nascent absorber layer and/or substrate includes increasing the temperature of the absorber layer and/or substrate at a rate of between about 5° C./sec and about 150° C./sec.

* * * * *